US010218128B2

(12) United States Patent
Tseng

(10) Patent No.: US 10,218,128 B2
(45) Date of Patent: Feb. 26, 2019

(54) SIGNAL CONNECTOR HAVING TERMINALS IN CONTACT WITH THE GROUND PIECE BY MEANS OF A BENDING PORTION

(71) Applicant: SIMULA TECHNOLOGY INC., Taoyuan (TW)

(72) Inventor: Te-Chih Tseng, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 15/805,190

(22) Filed: Nov. 7, 2017

(65) Prior Publication Data

US 2018/0366882 A1 Dec. 20, 2018

(30) Foreign Application Priority Data

Jun. 15, 2017 (TW) ..... 106120016 A

(51) Int. Cl.

| | |
|---|---|
| ***H01R 13/6591*** | (2011.01) |
| ***H01R 13/6582*** | (2011.01) |
| ***H01R 12/77*** | (2011.01) |
| ***H01R 13/6594*** | (2011.01) |
| ***H01R 13/02*** | (2006.01) |
| ***H01R 13/40*** | (2006.01) |
| ***H01R 13/6471*** | (2011.01) |
| ***H01R 13/516*** | (2006.01) |

(Continued)

(52) U.S. Cl.

CPC ..... *H01R 13/6591* (2013.01); *H01R 12/775* (2013.01); *H01R 13/02* (2013.01); *H01R 13/40* (2013.01); *H01R 13/516* (2013.01); *H01R 13/6471* (2013.01); *H01R 13/6582* (2013.01); *H01R 13/6594* (2013.01); *H01R 13/652* (2013.01); *H01R 24/60* (2013.01); *H01R 2107/00* (2013.01)

(58) Field of Classification Search

CPC ..... H01R 13/6591

See application file for complete search history.

(56) References Cited

U.S. PATENT DOCUMENTS 6,540,567 B1 * 4/2003 Yeh ..... H01R 13/2442 439/701

9,444,199 B2 * 9/2016 Leng ..... H01R 13/6596

(Continued)

*Primary Examiner* — Ross N Gushi

(74) *Attorney, Agent, or Firm* — Bacon & Thomas, PLLC

(57) ABSTRACT

The present invention discloses a signal connector having terminals in contact with a ground piece by means of a bending portion, comprising an insulating base body, a first terminal assembly, a second terminal assembly and a ground piece. The terminal assemblies are inserted on to the insulating base body at locations adjacent to the top and bottom portions thereof, respectively; the ground piece is inserted in the gap of the insulating base body corresponding to the location between terminal assemblies. The outermost positions of both sides of terminal assemblies act as a grounding terminal respectively. Features of the signal connector include: a bending portion is formed at the peripheral of the ground piece or each front end of grounding terminals, respectively. Each bending portion connects the corresponding grounding terminal with the ground piece electrically to create a complete shielding effect and interference prevention of high frequency signals between terminal assemblies.

4 Claims, 7 Drawing Sheets

(51) Int. Cl.

| | |
|---|---|
| *H01R 107/00* | (2006.01) |
| *H01R 13/652* | (2006.01) |
| *H01R 24/60* | (2011.01) |

(56) References Cited

U.S. PATENT DOCUMENTS

| | | | | |
|---|---|---|---|---|
| 9,634,437 | B2 * | 4/2017 | Kao | H01R 13/6596 |
| 9,837,734 | B2 * | 12/2017 | Wang | H01R 11/12 |
| 2016/0149349 | A1 * | 5/2016 | Kao | H01R 13/6586 439/607.05 |

* cited by examiner

SIGNAL CONNECTOR HAVING TERMINALS IN CONTACT WITH THE GROUND PIECE BY MEANS OF A BENDING PORTION

FIELD OF THE INVENTION

The present invention relates to a signal connector having terminals in contact with the ground piece by means of a bending portion, especially a signal connector structure having a bending portion provided in the peripheral location of a ground piece or the front end of a grounding terminal so that the ground piece is electrically connected with the grounding terminal so as to enhance the shielding effect.

BACKGROUND OF THE INVENTION

Generally, signal connectors refer to all connection elements and auxiliary accessories thereof used for the electrical signal and power applications. Signal connectors bridge all signals and their quality affects the electricity and signal transmission reliability. Furthermore, signal connectors are closely related to the operation of electronic systems. Following the ever advancing development of electronic technology, the signal connector has become an indispensable equipment for all kinds of electronic devices to transmit data and connect to other peripheral devices. Among the transmission specifications of many connectors, universal serial bus (USB) is the most popular one.

Currently, the USB specification will soon fully enter USB 3.1. In order to enhance the transmission speed, transmission signal type, convenience for plug and unplug, the industry further introduces "Type-C connector". The structure of Type-C connector has a significant change that is an "up-down symmetrical structure". Users no longer need to identify the up side and bottom side of the plug specifically and, instead, can simply insert the plug to the corresponding socket, allowing the behavior that users do by instinct. However, in order to allow the plug to be inserted without the need of flipping the up side or bottom side around, Type-C connector must be provided with two identical sets of connection terminals. In addition, in order to prevent interference between signals of two sets of terminals, a ground piece must be provided within the connector thus to separate these two sets of terminals.

As the current industrial trend focuses on the mainstream design of electronic devices that are light weighted, slim and small in size, such specification for Type-C connectors of USB 3.1 poses difficulty and new challenges for the production and assembly process. Especially, when the structure becomes smaller, the distance between terminals undoubtedly is shortened, resulting in the degradation of the shielding effect of the aforementioned ground piece. Therefore, how to further improve the connector structure is the important topic that the present invention intends to solve.

SUMMARY OF THE INVENTION

One objective of the present invention is to provide a signal connector having terminals in contact with a ground piece by means of a bending portion, which at least includes an insulating base body, a first terminal assembly, a second terminal assembly and a ground piece, wherein the first terminal assembly is inserted on to the insulating base body at the location adjacent to the top portion thereof; the second terminal assembly is inserted on to the insulating base body at the location adjacent to the bottom portion thereof; the ground piece is inserted in the gap of the insulating base body corresponding to the location between the first terminal assembly and the second terminal assembly. The features of the signal connector include the first terminal assembly having a plurality of first terminals wherein two first terminals disposed at the outermost positions of both sides respectively are the first grounding terminals and the rear ends of the first grounding terminals can be welded respectively to the grounding circuit on the circuit board; the second terminal assembly having a plurality of second terminals wherein two second terminals disposed at the outermost positions of both sides respectively are the second grounding terminals and the rear ends of the second grounding terminals can be welded respectively to the grounding circuit on the circuit board; the ground piece having a first bending portion and a second bending portion at the peripheral locations thereof adjacent to the first grounding terminals and the second grounding terminals respectively wherein the bending portions are in contact with the first grounding terminals and the second grounding terminals respectively to form electrical connections so that the first grounding terminals of the first terminal assembly and the second grounding terminals of the second terminal assembly are electrically connected to the ground piece through the bending portions respectively and also electrically connected to one another to create a more complete shielding effect and interference prevention of high frequency signals between the terminal assemblies.

Another objective of the present invention is to provide another type of signal connector having terminals in contact with a ground piece by means of a bending portion, which at least includes an insulating base body, a first terminal assembly, a second terminal assembly and a ground piece, wherein the first terminal assembly is inserted on to the insulating base body at the location adjacent to the top portion thereof; the second terminal assembly is inserted on to the insulating base body at the location adjacent to the bottom portion thereof; the ground piece is inserted in the gap of the insulating base body corresponding to the location between the first terminal assembly and the second terminal assembly. The features of the signal connector include the first terminal assembly having a plurality of first terminals wherein two first terminals disposed at the outermost positions of both sides respectively are the first grounding terminals; the rear ends of the first grounding terminals can be welded respectively to the grounding circuit on the circuit board; the front ends of the first grounding terminals respectively have a first bending portion toward the ground piece in order to electrically connect to the ground piece; the second terminal assembly having a plurality of second terminals wherein two second terminals disposed at the outermost positions of both sides respectively are the second grounding terminals; the rear ends of the second grounding terminals can be welded respectively to the grounding circuit on the circuit board; the front ends of the second grounding terminals respectively have a second bending portion toward the ground piece in order to electrically connect to the ground piece.

BRIEF DESCRIPTION OF THE DRAWINGS

The objectives, technical features, and effects of the present invention can be better understood by referring to the following detailed description of some illustrative embodiments in conjunction with the accompanying drawings, in which.

DETAILED DESCRIPTION OF THE PREFERRED EMBODIMENTS

Figure 1:
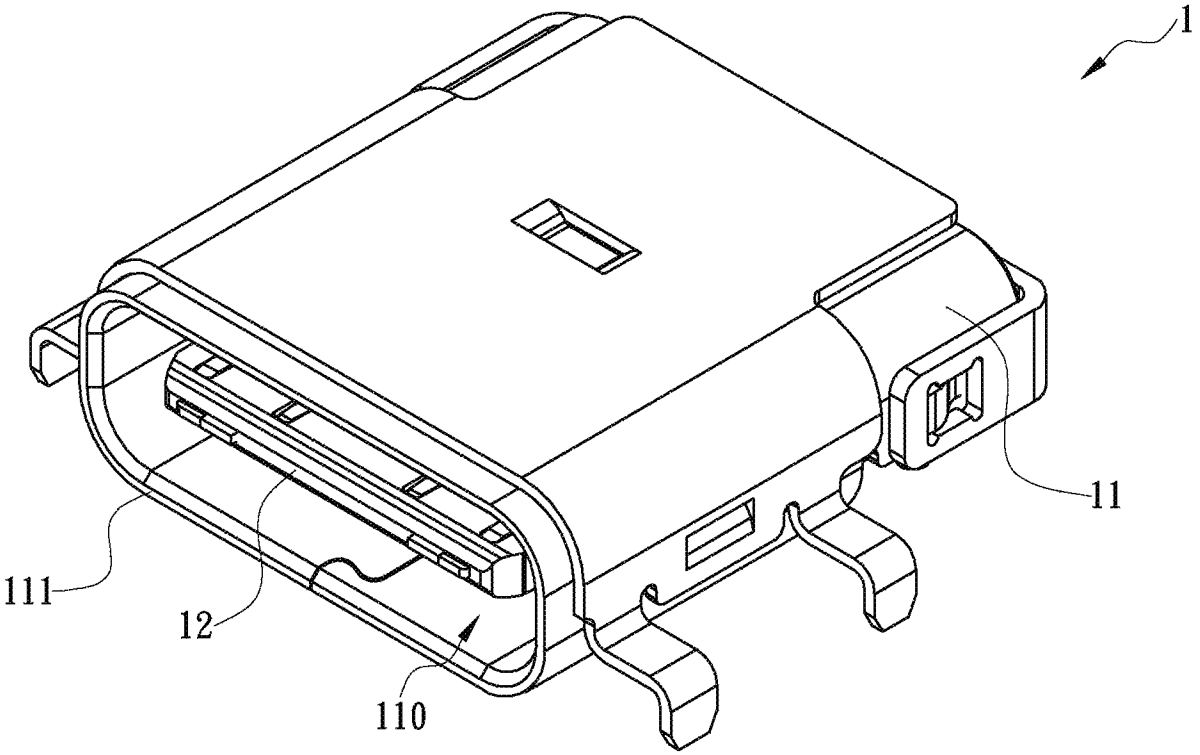
FIG. 1 is a schematic diagram of the signal connector of the present invention.
Figure 2:
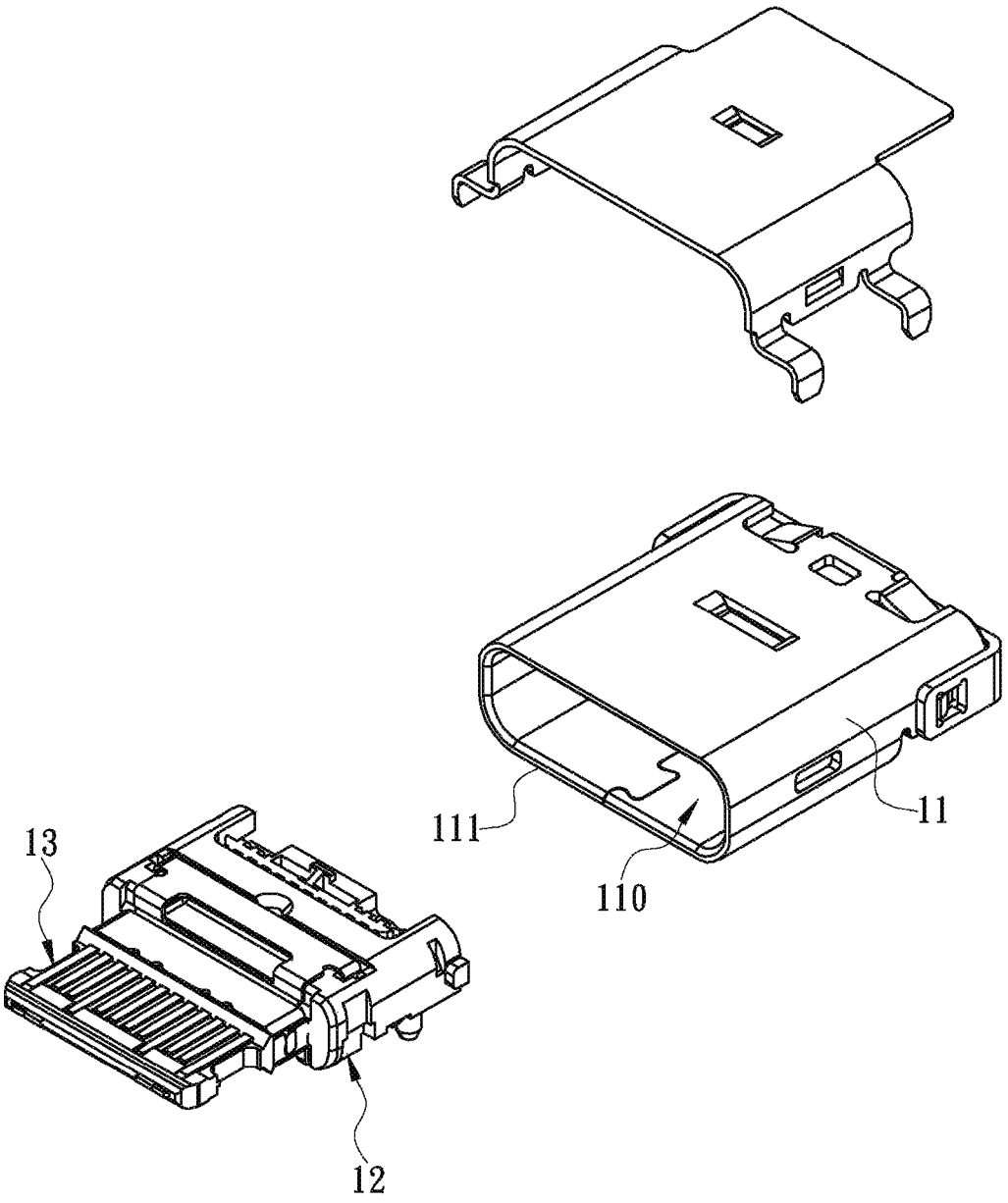
FIG. 2 is a composite schematic diagram of the signal connector of the present invention.

The present invention relates to a signal connector 1 having terminals in contact with a ground piece by means of a bending portion. Please refer to FIG. 1 to FIG. 3A for the illustrations of the first preferred embodiment of the present invention. The signal connector 1 includes a housing 11, an insulating base body 12, a first terminal assembly 13, a second terminal assembly 14, and a ground piece 15, wherein the housing 11 is provided with an inserting opening 111 at the front end and a receiving space 110 therewithin; the insulating base body 12 is provided in the receiving space 110; the first terminal assembly 13 is inserted on to the insulating base body 12 at the location adjacent to the top portion thereof; the second terminal assembly 14 is inserted on to the insulating base body 12 at the location adjacent to the bottom portion thereof; the ground piece 15 is inserted in the gap of the insulating base body 12 corresponding to the location between the first terminal assembly 13 and the second terminal assembly 14.

In this embodiment, the ground piece 15 is directly mounted in the insulating base body 12 through the injection molding manufacturing process and the insulating base body 12 is provided with a plurality of terminal slots 120 at the location adjacent to the top and the bottom portions thereof respectively for inserting the first terminal assembly 13 and the second terminal assembly 14 respectively. However, it shall be explained in advance that in other embodiments of the present invention, manufacturers can also mount the first terminal assembly 13 and the second terminal assembly 14 to the insulating base body 12 by performing multiple injection molding manufacturing processes.

Again, please refer to FIG. 1 to FIG. 3A. The first terminal assembly 13 includes a plurality of first terminals. The first terminals respectively function to transmit high frequency signals, detect signals, and provide power, etc. wherein two first terminals disposed at the outermost positions of both sides respectively, namely the first grounding terminals 131, have the grounding function. The rear ends of the first grounding terminals 131 can be welded respectively to the grounding circuit on the circuit board.

Similarly, the second terminal assembly 14 includes a plurality of second terminals. Two second terminals disposed at the outermost positions of both sides respectively are the second grounding terminals 141 and the rear ends of the second grounding terminals 141 can be welded respectively to the grounding circuit on the circuit board. The ground piece 15 has a first bending portion 151 and a second bending portion 152 at the peripheral locations thereof adjacent to the first grounding terminals 131 and the second grounding terminals 141 respectively, wherein the first bending portions 151 and the second bending portions 152 are in contact with the first grounding terminals 131 and the second grounding terminals 141 respectively to form electrical connections.

Therefore, the first grounding terminals 131 of the first terminal assembly 13 and the second grounding terminals 141 of the second terminal assembly 14 are electrically connected to the ground piece 15 through the bending portion 151 and the bending portion 152 respectively and also electrically connected to one another to create a more complete shielding effect and interference prevention of high frequency signals between the first terminal assembly 13 and the second terminal assembly 14.

Figure 3A:
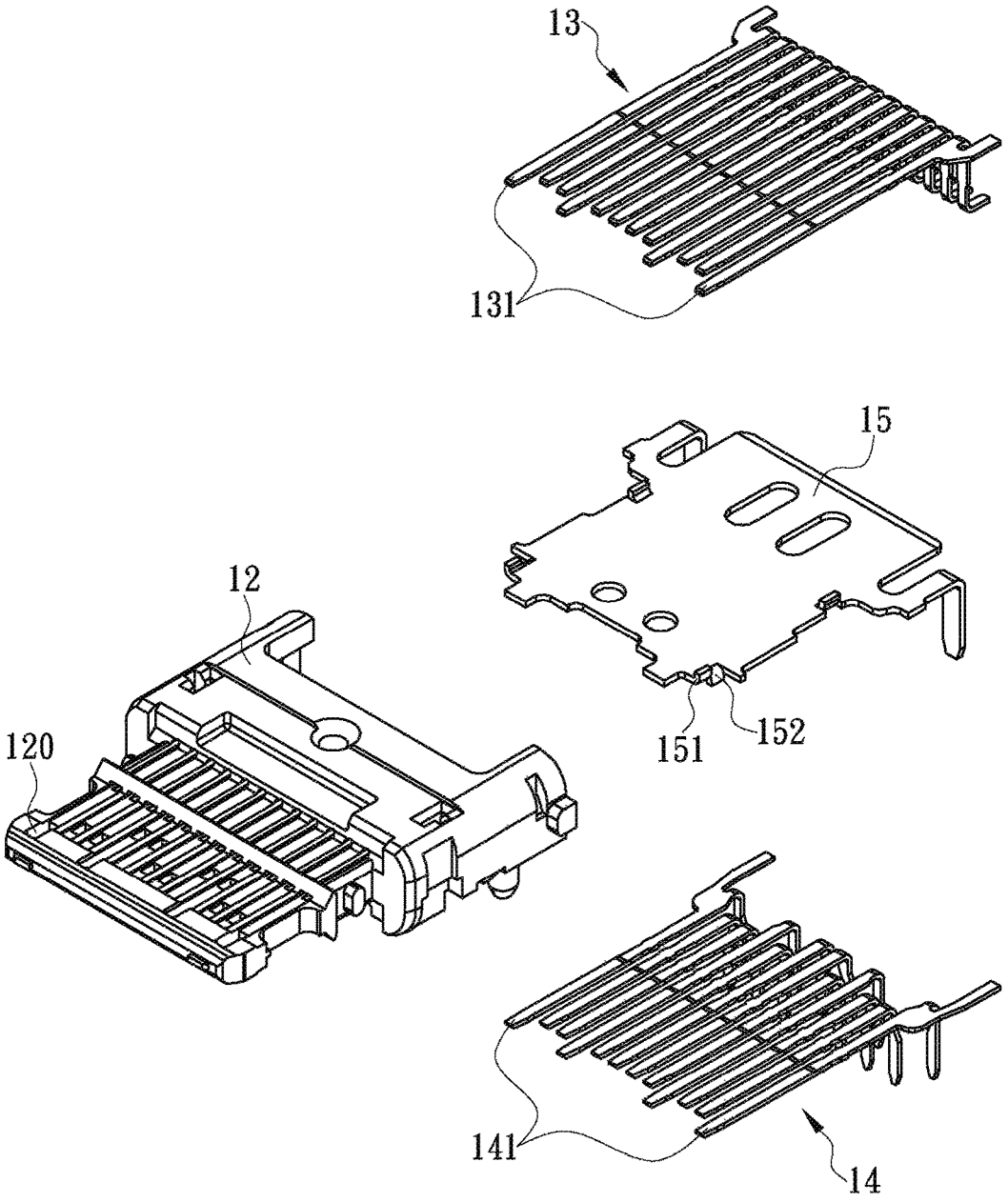
FIG. 3A is the schematic diagram of the first preferred embodiment of the signal connector of the present invention.
Figure 3B:
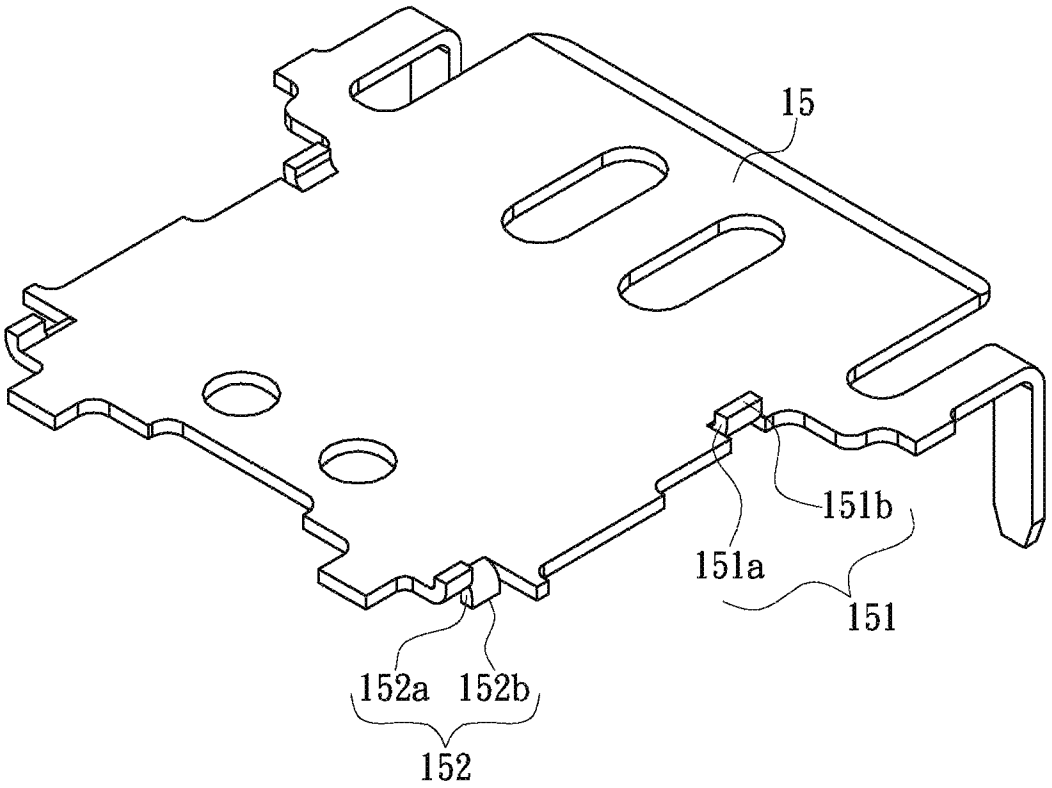
FIG. 3B is the schematic diagram of the first preferred embodiment of the signal connector of the present invention.

Please refer to FIG. 3A and FIG. 3B. In this embodiment, the bending portion 151 and the bending portion 152, produced by a stamping and bending method, include an arc-shaped portion 151*a* and an arc-shaped portion 152*a* respectively, and a contact portion 151*b* and a contact portion 152*b* respectively. One end of the arc-shaped portion 151*a* and the arc-shaped portion 152*a* is respectively connected to the ground piece 15 and a middle portion thereof is in a curved arc angle bending shape respectively. The contact portion 151*b* and the contact portion 152*b* are provided on the other end of the arc-shaped portion 151*a* and the arc-shaped portion 152*a* respectively, and have a contact surface respectively wherein the contact surface is in contact with the corresponding first grounding terminal 131 or the second grounding terminal 141.

Figure 4A:
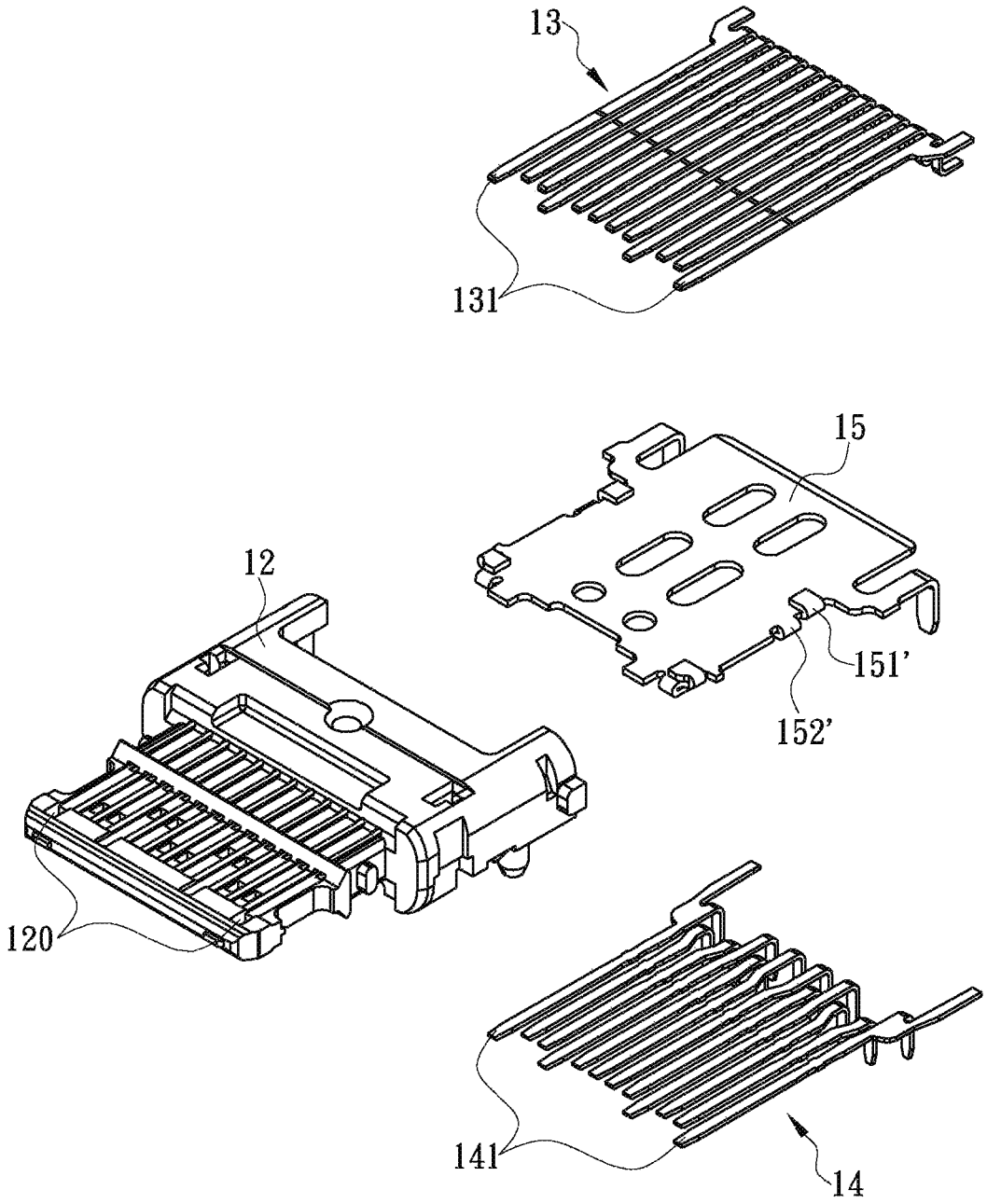
FIG. 4A is the schematic diagram of the second preferred embodiment of the signal connector of the present invention.
Figure 4B:
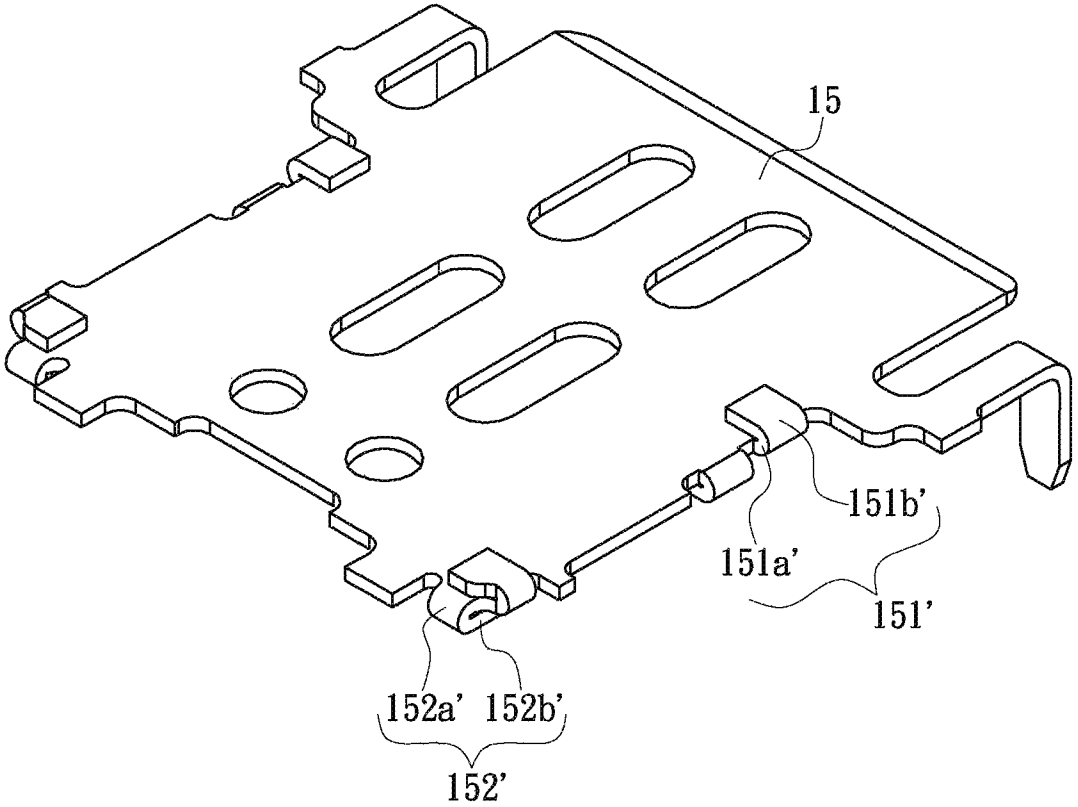
FIG. 4B is the schematic diagram of the second preferred embodiment of the signal connector of the present invention.

Please refer to FIG. 4A and FIG. 4B for the illustrations of the second preferred embodiment. The signal connector 1 also includes a housing 11, an insulating base body 12, a first terminal assembly 13, a second terminal assembly 14, and a ground piece 15. The structures of the insulating base body 12, the first terminal assembly 13, and the second terminal assembly 14 are the same as those of the aforementioned previous embodiment and, therefore, will not be repeated again. The present embodiment mainly changes the structure of the bending portion. The bending portion 151' and the bending portion 152' include an arc-shaped portion 151*a'* and an arc-shaped portion 152*a'* respectively and a contact portion 151*b'* and a contact portion 152*b'* respectively. One end of the arc-shaped portion 151*a'* and the arc-shaped portion 152*a'* respectively is connected to the ground piece 15 and a middle portion thereof is in a curved arc angle bending shape respectively. The contact portion 151*b'* and the contact portion 152*b'* are provided on the other end of the arc-shaped portion 151*a'* and the arc-shaped portion 152*a'* respectively, and have one side surface pressing against the peripheral location of the ground piece 15 respectively and the other side surface in contact with the corresponding first grounding terminals 131 or the second grounding terminals 141 respectively. In addition, to enhance the contact stability, manufacturers also can weld the contact portion 151*b'* and the contact portion 152*b'* on to the corresponding first grounding terminal 131 or the second grounding terminal 141 respectively by laser spot welding.

As described before, in the first and second embodiments of the present invention, the first terminal assembly 13 and the second terminal assembly 14 are inserted into a plurality of terminal slots 120 of the insulating base body 12 respectively. The terminal slots 120 corresponding to the first grounding terminals 131 and the second grounding terminals 141 respectively are connected to the ground piece 15, so that the bending portion 151 and the bending portion 152 of the ground piece 15 can extend into the bottom of the terminal slots 120 respectively.

Furthermore, the bending portions 151, 152, 151', and 152' can be disposed on the ground piece 15 near the front end thereof or on the ground piece 15 near the middle portion thereof wherein both settings can achieve the same effect. In the aforementioned previous embodiment, the first bending portion 151 and the first bending portion 151', the second bending portion 152 and the second bending portion 152' are respectively disposed in adjacent locations in order to ensure balance of structural strength of the ground piece 15.

Figure 5:
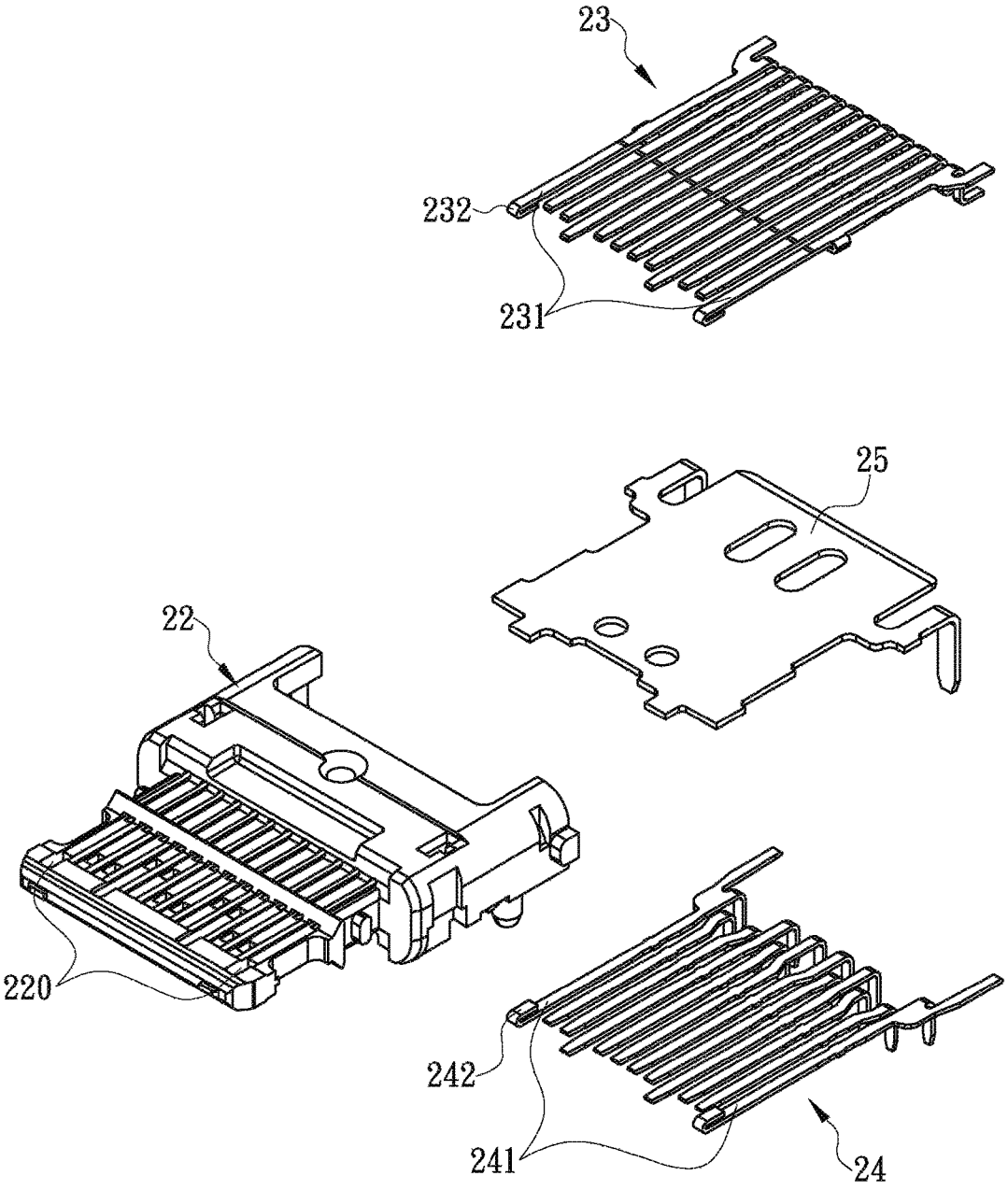
FIG. 5 is the schematic diagram of the third preferred embodiment of the signal connector of the present invention.

Please refer to FIG. 1 and FIG. 5 for illustrations of the third preferred embodiment of the present invention. The signal connector 1 also includes a housing 11 (as shown in FIG. 1), an insulating base body 22, a first terminal assembly 23, a second terminal assembly 24, and a ground piece 25, wherein the first terminal assembly 23 is inserted on to the insulating base body 22 at the location adjacent to the top portion thereof; the second terminal assembly 24 is inserted on to the insulating base body 22 at the location adjacent to the bottom portion thereof; the ground piece 25 is inserted in the gap of the insulating base body 22 corresponding to the location between the first terminal assembly 23 and the second terminal assembly 24.

The first terminal assembly 23 includes a plurality of first terminals wherein two first terminals disposed at the outermost positions of both sides respectively are the first grounding terminals 231; the rear ends of the first grounding terminals 231 can be welded respectively to the grounding circuit on the circuit board; the front ends of the first grounding terminals 231 respectively have a first bending portion 232 toward the ground piece 25 in order to electrically connect to the ground piece 25. In the third embodiment, the front end of the first grounding terminal 231 respectively has a 180-degree U-bend shape and, in other words, the front end of the first grounding terminal 231 is bent backward to the rear direction of the first grounding terminal 231 in order to form the first bending portion 232 (as shown in FIG. 5). Therefore, the first grounding terminal 231 has a much larger contact area in contact with the ground piece 25 electrically.

The second terminal assembly 24 includes a plurality of second terminals wherein two second terminals disposed at the outermost positions of both sides respectively are the second grounding terminals 241; the rear ends of the second grounding terminals 241 can be welded respectively to the grounding circuit on the circuit board; the front ends of the second grounding terminals 241 respectively have a second bending portion 242 toward the ground piece 25 in order to electrically connect to the ground piece 25. In the third embodiment, the front end of the second grounding terminals 241 respectively has a 180-degree U-bend shape and, in other words, the front end of the second grounding terminal 241 is bent backward to the rear direction of the second grounding terminal 241 in order to form the second bending portion 242 (as shown in FIG. 5). Therefore, the second grounding terminal 241 has a much larger contact area in contact with the ground piece 25 electrically.

In this embodiment, the first terminal assembly 23 and the second terminal assembly 24 respectively are inserted in the plurality of terminal slots 220 of the insulating base body 22 and the bottom of the terminal slot 220 is connected to the ground piece 25, so that the bending portion 232 and the bending portion 242 can extend through the terminal slots 220 to be in contact with the ground piece 25 respectively. However, as described previously, the terminal assembly 23 and the terminal assembly 24 can be mounted onto the insulating base body 22 through the injection molding manufacturing process. In addition, based on the test results produced by the patent applicant, when the signal connector 1 is in a horizontal form (as shown in FIG. 1 and FIG. 5) and only the front end of the first grounding terminal 231 is provided with a corresponding first bending portion 232, the first grounding terminal 231 and the ground piece 25 still can provide a very good shielding effect.

While the invention herein disclosed has been described by means of specific embodiments, numerous modifications and variations could be made thereto by those skilled in the art without departing from the scope of the invention set forth in the claims.

What is claimed is:

1. A signal connector having terminals in contact with a ground piece by means of a bending portion, which at least includes an insulating base body, a first terminal assembly, a second terminal assembly and a ground piece, wherein the first terminal assembly is inserted on to the insulating base body at the location adjacent to the top portion thereof; the second terminal assembly is inserted on to the insulating base body at the location adjacent to the bottom portion thereof; the ground piece is inserted in the gap of the insulating base body corresponding to the location between the first terminal assembly and the second terminal assembly; the features of the signal connector include:

the first terminal assembly having a plurality of first terminals wherein two first terminals disposed at the outermost positions of both sides respectively are the first grounding terminals and the rear ends of the first grounding terminals can be welded respectively to the grounding circuit on the circuit board;

the second terminal assembly having a plurality of second terminals wherein two second terminals disposed at the outermost positions of both sides respectively are the second grounding terminals and the rear ends of the second grounding terminals can be welded respectively to the grounding circuit on the circuit board; and the ground piece having a first bending portion and a second bending portion at the peripheral locations thereof adjacent to the first grounding terminals and the second grounding terminals respectively wherein the bending portions are in contact with the first grounding terminals and the second grounding terminals respectively to form electrical connections, and each bending portion includes an arc-shaped portion and a contact portion; one end of the arc-shaped portion is connected to the ground piece and a middle portion thereof is in a curved arc angle bending shape; the contact portion is provided on the other end of the arc-shaped portion and has one side surface pressing against the peripheral location of the ground piece and the other side surface in contact with the corresponding first grounding terminals or the second grounding terminals.

2. The signal connector as claimed in claim 1, wherein each first terminal assembly and each second terminal assembly are inserted into a plurality of terminal slots of the insulating base body respectively and the bending portion can extend into the bottom of the terminal slot.

3. The signal connector as claimed in claim 2, wherein each bending portion is disposed on the ground piece near the front end thereof.

4. The signal connector as claimed in claim 2, wherein each bending portion is disposed on the ground piece near the middle portion thereof.

* * * * *